US006827349B2

(12) United States Patent
Huang

(10) Patent No.: US 6,827,349 B2
(45) Date of Patent: Dec. 7, 2004

(54) BILLIARD TABLE

(76) Inventor: He Huang, Suite 1-202, No. 24, Haite Garden, Shijingshan District, Beijing (CN), 100041

( * ) Notice: Subject to any disclaimer, the term of this patent is extended or adjusted under 35 U.S.C. 154(b) by 56 days.

(21) Appl. No.: 10/276,052

(22) PCT Filed: May 11, 2001

(86) PCT No.: PCT/CN01/00736

§ 371 (c)(1),
(2), (4) Date: Nov. 12, 2002

(87) PCT Pub. No.: WO01/97933

PCT Pub. Date: Dec. 27, 2001

(65) Prior Publication Data

US 2003/0102626 A1 Jun. 5, 2003

(30) Foreign Application Priority Data

May 12, 2000 (CN) ..... 00107452 A

(51) Int. Cl.[7] ..... A63F 9/00; A63F 3/02

(52) U.S. Cl. ..... 273/309; 273/258

(58) Field of Search ..... 273/258, 282.1, 273/287, 241, 309

(56) References Cited

U.S. PATENT DOCUMENTS

| | | | | | |
|---|---|---|---|---|---|
| 3,001,843 | A | * | 9/1961 | Davis | 108/62 |
| 3,964,747 | A | * | 6/1976 | Balmforth | 273/261 |
| 4,529,206 | A | * | 7/1985 | Curry et al. | 273/261 |
| 4,772,027 | A | * | 9/1988 | Martel et al. | 273/237 |
| 5,324,040 | A | * | 6/1994 | Panda | 273/272 |
| 5,582,410 | A | * | 12/1996 | Hunt | 273/261 |
| 5,660,388 | A | * | 8/1997 | Benn | 273/241 |
| 6,416,056 | B1 | * | 7/2002 | Knieriemen | 273/261 |
| 2002/0167128 | A1 | * | 11/2002 | Selman | 273/258 |

FOREIGN PATENT DOCUMENTS

| | | |
|---|---|---|
| CN | 2203171 Y | 7/1995 |
| CN | 2270536 Y | 12/1997 |
| CN | 2298043 Y | 11/1998 |

* cited by examiner

*Primary Examiner*—Derris H. Banks
*Assistant Examiner*—Faye Francis
(74) *Attorney, Agent, or Firm*—Greer, Burns & Crain, Ltd.

(57) ABSTRACT

A table includes a bank and a panel, wherein a plurality of ball positions are evenly arranged into equilateral concentric hexagons in the panel, a bank is positioned around the panel, a plurality of holes are configured in the inner wall of the bank and in the board which is connected to the bank. During playing, players move their own balls to the target area by skipping, raising, hitting balls or throwing balls.

10 Claims, 4 Drawing Sheets

BILLIARD TABLE

FIELD OF THE INVENTION

This invention relates to an instrument for playing chess games, specifically relates to an instrument for playing chess games and ball games which includes a table.

BACKGROUND OF THE INVENTION

Most of current instruments for playing jumping chess and ball games only have rather few functions and less combination forms, so they have a narrow application. It is difficult to manufacture products in different sizes with the same design concepts, using the same manufacturing method by resizing. It is difficult to play games on them in the same mode even if they are manufactured. Moreover, it is impossible to play Chinese jumping chess and ball games on a single table.

A billiard table as exemplified in China utility model patent CN2298043Y has rather few functions, in which no round pits or round apertures with a given depth are evenly arranged on the top of the table for positioning balls, so you can only play ball games but can not play Chinese jumping chess on it. Because no enclosure is provided around the table, balls are likely to run out onto ground when you throw them toward the holes or raising them over the table bank toward the holes. This makes it difficult to play games on it on the one hand, on the other hand, this may cause some safety problems. It is almost impossible to play games by throwing balls or raising balls. Furthermore, it is difficult to control the rebounds of the balls and to determine the rebound angles of the balls because the inner wall of the bank is round.

Though a table described in China utility model patent CN2270536Y has a jumping chess board fixed on its back, the problem is that you can't use the table to play ball games and use the board to play jumping chess at the same time.

In addition, a billiard table disclosed in China utility model patent CN2203171Y has a top panel which can horizontally rotate around its center, but in its embodiments, only a technical scheme in which the table can rotate around a bearing on the table support is disclosed, and the table has only one support point, thus when a player hit a ball with the support of the periphery of the table, the table will tilt to one side, which will make the table and the moving of the balls instable. Moreover, it is impossible to make the table very large. Besides, in the embodiment, the table is rectangular, so it will interfere with player position when it is turned around.

Thus, the object of this invention is to provide a ball table, which can be easily manufactured by resizing without affecting its functions, and can function as a ball table and a chess table, therefore, it has wide application and can provide ease, safety and stability for playing.

DISCLOSURE OF THE INVENTION

This invention provides a technical scheme to implement the object described above:

A ball table includes a bank, a panel and a board, wherein said top panel is disposed on said board, a plurality of round pits are provided in said panel as ball positions, said ball positions are evenly arranged into hexagons layer by layer in said panel, said bank is positioned around said panel and is higher than said panel, a plurality of holes are provided in said bank and said board which is connected to said bank.

In said table, the distances between every two adjacent layers of said ball positions are all the same, and the distances between every two ball positions are all the same, the ball position on one vertex of the inner wall of the bank and its two adjacent ball positions form the vertexes of a equilateral triangle, said ball positions are evenly arranged on the both sides of the midpoint of the line defined by two opposing ball holes, the distances between each two symmetric said ball positions and the center of entry surface of said hole are equal.

In said table, said panel is a horizontal plane layer made of elastic buffer material, and said ball positions are arranged in this plane.

In said table, said panel is a step-like pane and has more than two levels, and the ball positions near inner wall of said bank are higher than the ball positions near the center of said panel, said ball positions are arranged in the step-like panel, said panel is a layer of elastic buffer material, said ball positions are down through holes with straight wall in the layer of elastic material and said board.

In said table, an enclosure is disposed along the outer periphery of said bank, said enclosure has one or more layers, the top of said enclosure is a horizontal plane or a inclined plane inclining from inner to outer.

In said table, said enclosure has an upper layer enclosure and a lower layer enclosure, and the upper layer enclosure is wider than the lower layer enclosure, the inner wall of said upper layer enclosure is an inclined plane which tapers in width from top to bottom, a plurality of target areas indicating signs are fixed or engraved on the lower layer enclosure.

In said table, the outer wall of the enclosure is a circle or a polygon which has more than six sides, the inner wall of said enclosure is a circle or a dodecagon, the inner wall of said bank is a hexagon.

In said table, a table support is mounted under said board, a revolving disk is mounted between said board and said table support.

In said table, there are three parallel lines between every two most outer ball positions near said bank, the distance between said two ball positions is twice as much as the interval between said parallel lines connecting the ball positions.

In said table, said bank and said board is a integral, said holes include curved belly surface and curved entry surface, the holes has a small inlet and a large belly, said curved belly surface and curved entry surface are formed respectively of circular surfaces with different radii, said curved belly surface converges to said curved entry surface smoothly.

1. Not only a bank and holes but also a plurality of ball positions are configured in said table which are round pits or round holes with given depth and are evenly arranged into concentric hexagons, so the table has multiple functions. It can be used to play jumping chess games and playing ball games at the same time. Moreover, it allows more ball-hitting techniques, and makes simple jumping chess games more varied.
2. An enclosure is positioned along the periphery of the bank, it can substantially prevent the balls fallen on the bank from moving out of the table, this can facilitate throwing or raising ball.
3. Chessmen for almost all chess games except marble-jumping chess men are not spherical, and chessman positions are printed on a plane, so you can't play ball games on it. Prior chess table for marble-jumping chess has no bank which is needed to play ball games. Prior chess table for marble-jumping chess is hexangular, and it is hard to hit balls if a bank is disposed along the periphery of the hexangular chess table. According to the present invention, a bank is disposed around the hexagonal panel, such that the angles formed by the inner walls of the bank are obtuse but not acute, the number of the inner walls of the table bank is decreased. Ball positions 1 are arranged into hexagon layer by layer, this makes the area of the chess table increased by ⅓ than that of a hexangular table.

4. The outer periphery of the enclosure is a circle or a polygon which has more than six sides, this facilitates the rotating of the table and reduces the travel distance around the table with respect to a rectangular rotating ball table described in patent CN2203171Y, this can also speed up the games played by more than 3 players even if the table does not rotate. The inner walls of the bank define an equilateral hexagon, this makes it easier to hit rebounding balls than in a table with a circular inner wall of the table bank.
5. With ball positions evenly arranged layer by layer, the player can aim at a ball according to or with reference to a line linking two ball positions.
6. With ball positions evenly arranged layer by layer, regardless of the direction in which a ball moves, as long as you hit the ball with the same force and in the same way, the moving direction of the ball will be the same.
7. With ball positions evenly arranged layer by layer, you can hit balls and play gobang on the table, using balls you can also make up words or set up 3-D figures on it, so the table has many functions. When you only play jumping chess on the table its chess board and chessmen will be larger than traditional ones, and you will have more fun.
8. With the ball positions arranged all over the table or in a series of step-like planes, you need to overcome the resistant force a ball position exerted on the ball, when you hit the ball, this needs more techniques of hitting ball and you will have more fun.
9. With the ball positions arranged all over the table, the ball will change its moving direction once or many times unexpectedly because of continuous resistance to the ball, this makes games surprisingly enjoyable.
10. The ball positions 1 are pits with right wall, the angle formed by the wall of a pit and the panel 11 is a right angle, because right angle wall inlet has less resistance to the balls than rounded one, so it is easier to hit balls.
11. A rotating disk is disposed under the table, this makes it more stable during rotating the rotating disk than the table described in patent CN2203171Y which has a bearing disposed under it, so using the present table the player can rotate the table to a convenient position, and when the table is near a wall of a room or the player plays in a seat, space can be saved.
12. Because balls are positioned on ball positions defined by round pits, to some extent, the balls can maintain at their positions even if the table is tilted or vibrating, so the table can be used in a moving train.
13. The holes in a small-sized ball table are not holes through table board, so the ball table can be used as a common table when it is turned over, or it can be formed as a double side ball table, for example, the other side can be a billiard table.

Using above ball table, players can determine playing method freely according to the specific configuration of the table and ball moving rules during playing a game, this provides more fun and competition.

During playing a game, according to playing rules, each player moves his/her same-colored balls from start area to target area, and players can use a skipping ball, such as jumping chess, raising ball, hitting ball or throwing ball to move their balls, and the one who first moves all of his/her balls to target area is the winner.

PREFERRED EMBODIMENTS OF THIS INVENTION

Figure 2:
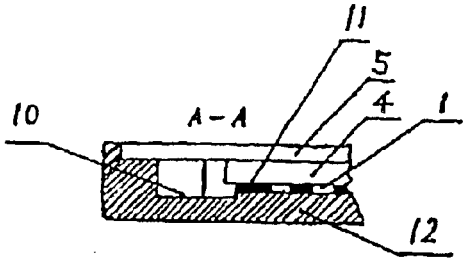
FIG. 2 is a sectional view taken along line A—A in FIG. 1, showing a hole with a bottom

Now the invention and its embodiments are further described in connection with the drawings.

In FIGS. 1, 2, 5, 8 and 9, a table according to this invention includes a plurality of ball positions 1, a bank 2, an enclosure 6, the outer wall 4 of the enclosure, the inner wall 5 of the enclosure, ball position connecting lines 7, ball position connecting bold lines 8, holes 9, the bottom 10 of ball holes, a panel 11, a board 12, a rotating disk 18, a rolling ball device 19, the upper rotating disk 20, elastic material 21, the lower rotating disk 22, a curved entry surface 91 of a hole and a curved belly surface 92 of a hole.

Figure 3:
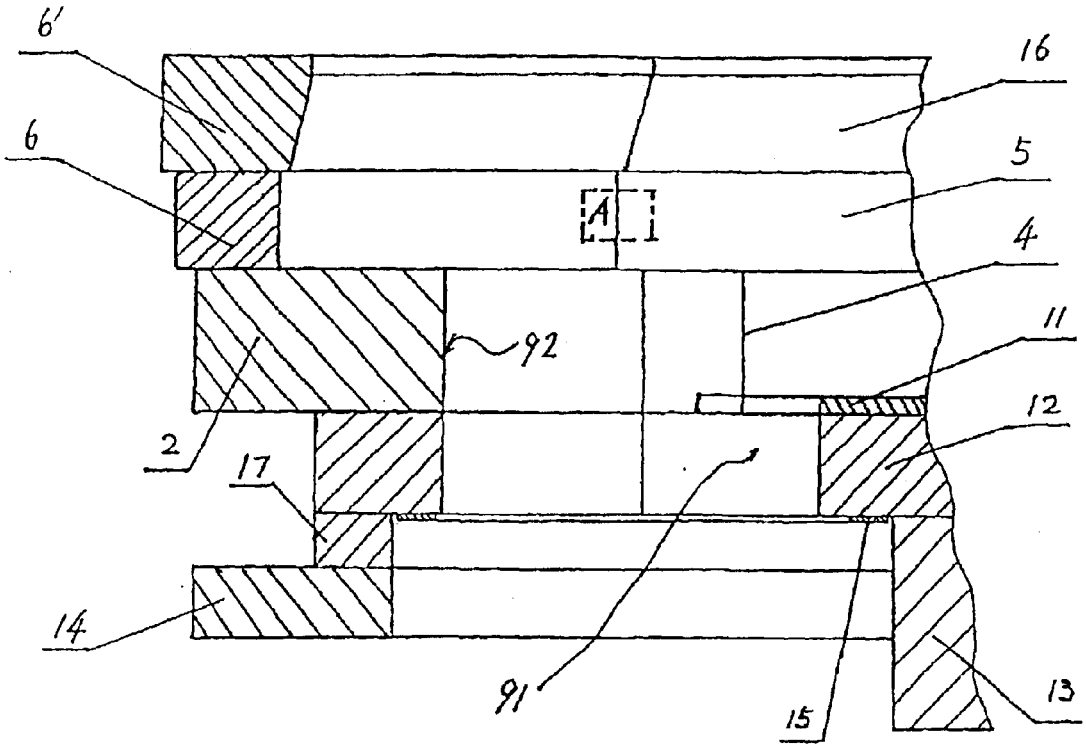
FIG. 3 is a enlarged sectional view taken along line A—A in FIG. 1, showing a through hole

In FIG. 3, an embodiment of table according to the present invention further includes an upper enclosure 6', a table board reinforcing frame 13, a decorating board 14, ball net pressing iron loops 15, an inner wall 16 of the upper layer enclosure and a heightening board 17.

Figure 7:
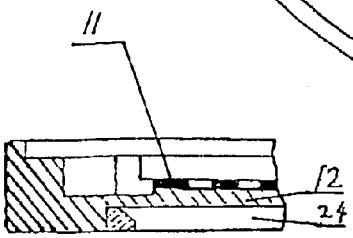
FIG. 7 is sectional view taken along line A—A in FIG. 1, where the back of table is also a panel
Figure 8:
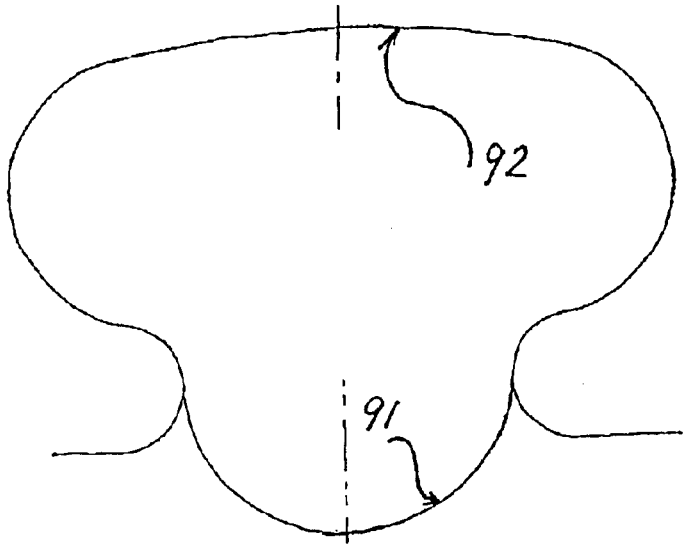
FIG. 8 is a schematic view of the surface configuration of a table hole according to the present invention
Figure 9:
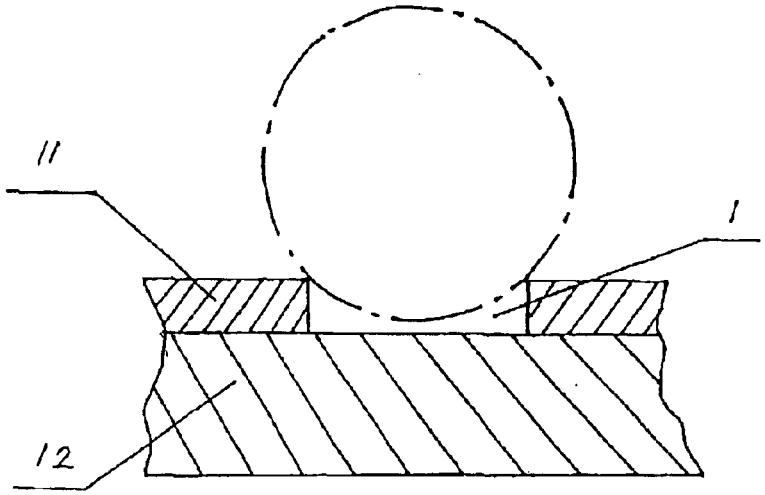
FIG. 9 is a schematic view of the configuration of a ball position with straight wall
Figure 10:
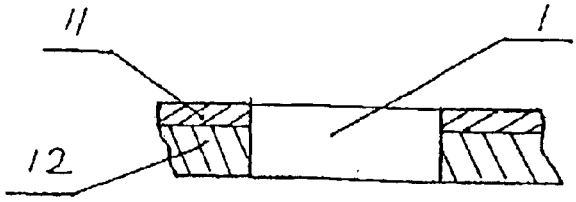
FIG. 10 is a schematic view of the configuration of a through hole ball position with straight wall

In FIG. 7, an embodiment of table according to the present invention further includes back table panel 24.

Embodiment Example 1

The layers of ball positions 1 and the inner wall 4 of the bank can be circular, polygonal or other shapes, but a hexagon shape is most preferred because it can be used in both chess games and ball games.

The outer wall 3 of the enclosure can be circular, circularoid or polygonal (for example, dodecagonal, hexagonal and decagonal). The outer wall 3 of the enclosure is preferred to be circular if the table is equipped with a rotating disk. Generally the outer wall 3 of the enclosure is the most outer periphery of a table. Its diameter can range from 200 mm to 2200 mm, and it can be larger or smaller.

The inner wall 5 of the enclosure can be dodecagonal or circular, and can be other polygonal.

The interval between adjacent ball positions depends on "the interval between a midline and its adjacent parallel line", and is called "interval of adjacent parallel lines" for short, the ratio of the diameter of the ball to the interval of adjacent parallel lines is about 1:0.9 to 1:1.15, and it can be larger or smaller.

The ratio of the diameter of the ball to the diameter of the ball position 1 is about 1:0.5 to 1:0.65, and it can be larger or smaller.

The diameter of the ball can range from 9 mm to 80 mm, and it can be larger or smaller.

"Number of parallel lines on the two sides of a midline" is called "number of parallel lines" for short, the number of layers in which ball positions are arranged depends on the number of parallel lines. The number of parallel lines can range from 16 to 32, and it can be larger or smaller.

The diameter of the outer wall 3 of the enclosure is the product of the interval of adjacent parallel lines and the number of parallel lines and the outer wall diameter coefficient.

The outer wall diameter coefficient is about 1.14 to 1.24, it can be a smaller value if the number of parallel lines is a large one, or it can be a larger value if the number of parallel lines is a small one.

The distance between the inner wall of the bank and the "outer-circle-center-lines" is the product of the diameter of the ball and the coefficient of the distance between the inner wall and the "outer-circle-center-lines".

The coefficient of the distance between the inner wall and the "outer-circle-center-lines" is about 0.6 to 1.

The height from the panel 11 to the top plane of the bank is the product of the diameter of the ball and the coefficient of the bank height.

The coefficient of the bank height is about 0.6 to 0.9, it will be a small value if the table has an enclosure 6.

The width of the hole 9 at the inner wall 4 of the bank where is the narrowest of the hole is the product of the diameter of the ball and the hole inlet coefficient.

The hole inlet coefficient is about 1.18 to 1.45.

More holes can be provided in the bank 2 at both sides of the hole 9, if it is needed.

The distance between the inner wall 5 of the enclosure and the back wall of the hole 9 is the product of the diameter of the ball and the enclosure-to-hole coefficient.

The enclosure-to-hole coefficient is about 0.6 to 2.

The height of the enclosure 6 is the product of the diameter of the ball and the enclosure height coefficient.

The enclosure height coefficient is about 0.35 to 3, also can be a larger or smaller value.

The enclosure height coefficient can be a larger value if the table is for playing in a standing posture.

As for heightening enclosure 6, overall heightening or part heightening can be used. Heightening-part can be mounted to each other by fixing, removable mounting and movable mounting, such as sliding, pivoting and inserting.

The enclosure 6 can be constructed into two or more layers for overall heightening enclosure 6. Upper layers enclosure 6' can be wider than the lower layer enclosure. In FIG. 3, the inner wall of the upper layer enclosure 6 can be a inclined plane tapering in width from top to bottom, in order to reduce the probability of balls' running out of the table. Because the balls can not contact to the lower layer enclosure, it is not necessary for the lower layer enclosure to be wrapped in elastic material. A plurality of target signs A can be positioned on the lower layer enclosure.

The height of the enclosure 6 is the same in a whole, but the sections of the enclosure 6 near the holes can be higher if it is needed.

The enclosure height coefficient can be a smaller value if the table is for playing by raising ball, not throwing ball in a sitting posture.

Besides enclosure 6, a net or shelf can be fixedly or movably mounted along the outer periphery of the table to block and receive running-out balls or store bats. The bank 2, the board 12 or the decorating board 14 can work as a shelf if their diameters are increased such that they extend beyond the outer periphery of the table.

A heightening board 17 can be disposed between the board 12 and the decorating board 14 so that bats can be put on the decorating board 14.

Now, an example is given for further description, wherein the diameter of the ball is 30 mm and the number of lines parallel to midline is 20. The parameters which are not described above can be calculated according to this example.

The ball positions 1 of the most outer layer on the panel 11 are arranged into a hexagon. The 6 lines which connect respective center of the ball positions 1 of the most outer layer are called "outer-circle-center-lines" for short. The length of each outer-circle-center-line is 360 mm. The diagonals of the hexagon formed by the 6 outer-circle-center-lines are called "table-diagonal" for short. The distance between the inner wall 4 of the bank and outer-circle-center-line is 24 mm. The diameter of the outer wall 3 of the enclosure is 880 mm.

Figure 1:
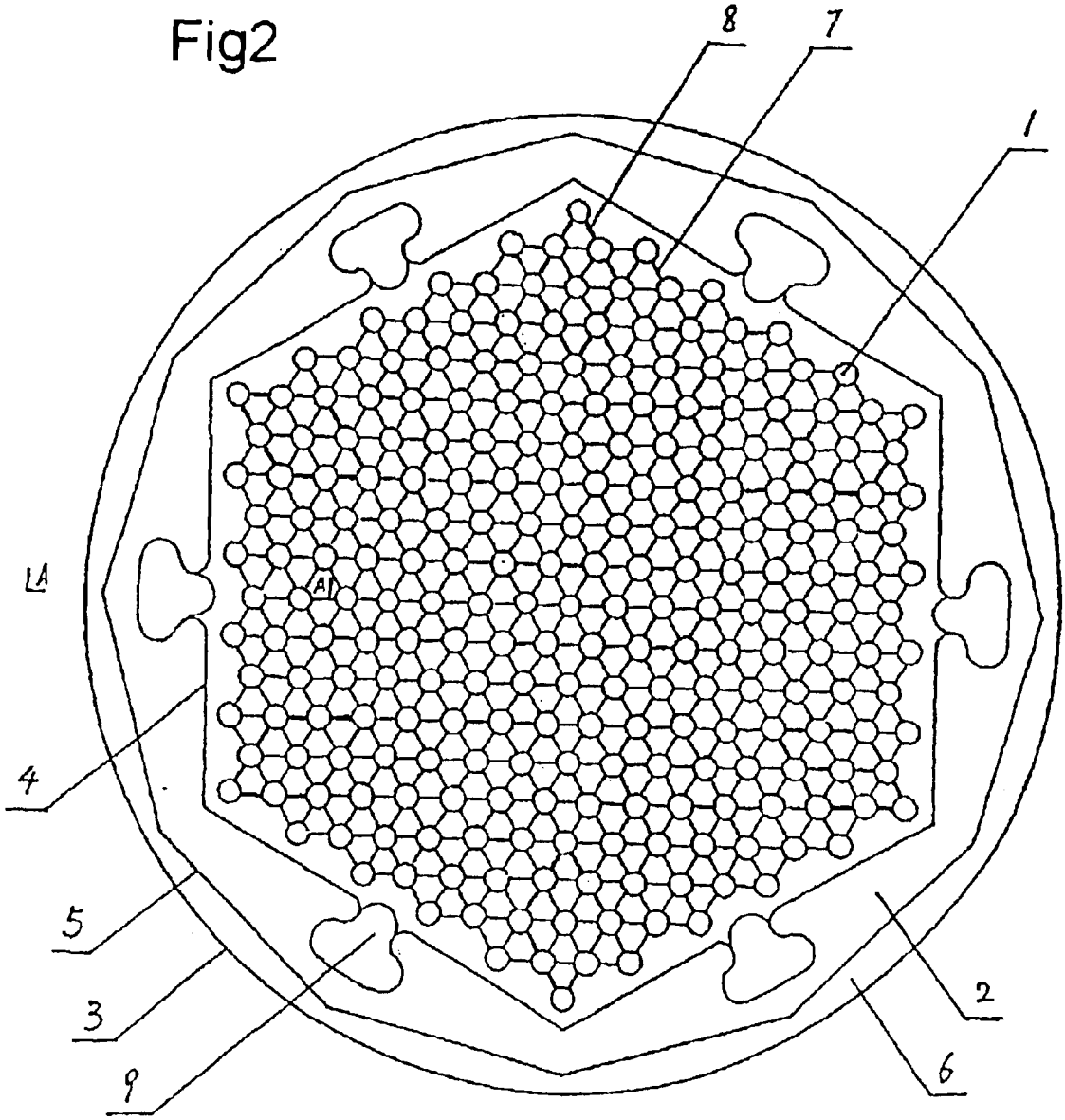
FIG. 1 is a schematic view of a table according to the present invention

FIG. 1 shows the arrangement of the ball positions 1 on the panel 11. The hexagon formed by six outer-circle-center-lines can be divided into 3 pairs of parallel outer-circle-center-lines the midpoint of every pair of the parallel outer-circle-center-lines is connected to form three "midlines" which are perpendicular to corresponding outer-circle-center-lines, then, 10 lines are respectively drawn on both sides of the 3 midlines with an interval of 36 mm, which are parallel to their midlines and intersect with their outer-circle-center-lines, after that, circles are drawn, which have a diameter of 16 mm and centers at all intersections except those at one of those only one line intersects with the outer-circle-center-lines and at another one of those a midline intersects with the outer-circle-center-lines within the hexagon formed by outer-circle-center-lines.

The thickness of the table board is 15 to 20 mm. The panel 11 is made of one layer or many layers of elastic material, such as foam, rubber, leather, etc. The panel 11 is stuck to the board 12 and the smooth side of leather is outward. Ball position is punched by a 16 mm diameter die on the panel. The thickness of the panel 11 is the depth of the ball positions, and the thickness of the panel 11 is 2.5 mm to 4 mm. The thickness should be increased if balls have a larger diameter.

The ball positions 1 are round pits or round holes. Round pit ball positions 1 have straight walls, that is, walls are perpendicular to their bottom. Chamfered inlets of pits can also be used. Resistance to moving balls will be greater if the inlets of the pits are chamfered, so the inlets of the pits should not be chamfered or should be chamfered as slightly as possible.

A table having a small size can be made by plaster casting technique, wherein the board 12 can be thinner, and the ball positions 1 can traverse through the board 12 to form a round aperture.

The bank 2 is 22 mm high. The cutouts of the holes 9 in the inner wall 4 of the bank are 38 mm wide. The hole bottom 10 is lower than the panel 11 by 8.5 to 13 mm. The holes 9 each can receive 1 to 4 balls, generally 3 balls. In addition, a plurality of pits can be configured in the bank between the holes to store balls, and different signs can be provided at bottoms of pits.

For a table of a larger size, the holes 9 should traverse through the table board 12, net-bags and net-bag pressing iron loops 15, or ball guiding tracks are disposed under the table board 12.

The enclosure 6 is 20 mm high.

Except the panel 11, the table can be made of wood, fiberboard, etc. it can also be made by casting. The holes 9, the bank 2, the enclosure 6 and the panel 11, to which balls can contact, should be wrapped in elastic material, leather, leatheroid and the like.

Embodiment 2

Figure 4:
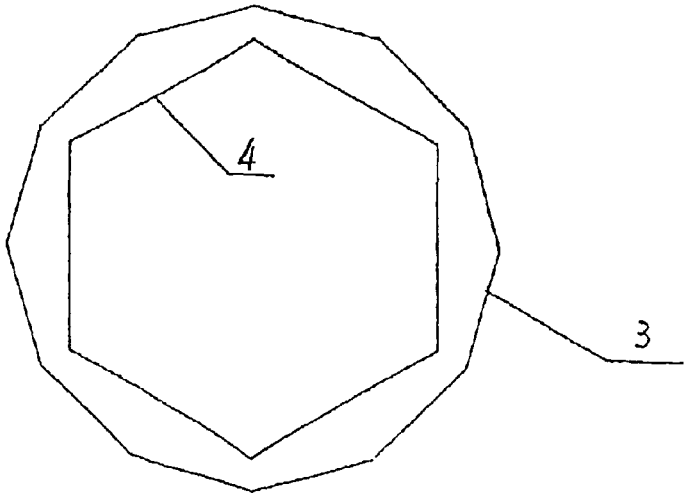
FIG. 4 is a schematic top view of the wall of the enclosure of a table according to an embodiment of the present invention
Figure 5:
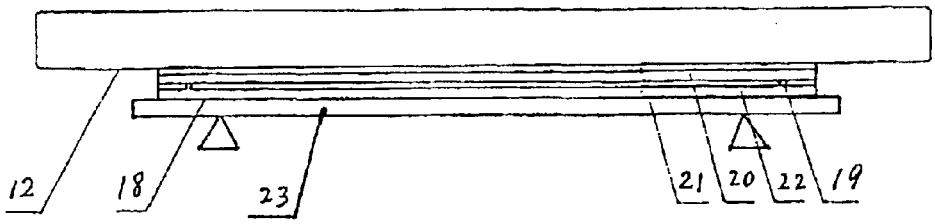
FIG. 5 is a schematic view of a table with a rotating disk according to an embodiment of present invention

Referring to FIG. 4, the outer wall of the enclosure according to this embodiment is a polygon which has more than six sides, all is the same as embodiment 1 for the others.

Embodiment 3

Figure 6:
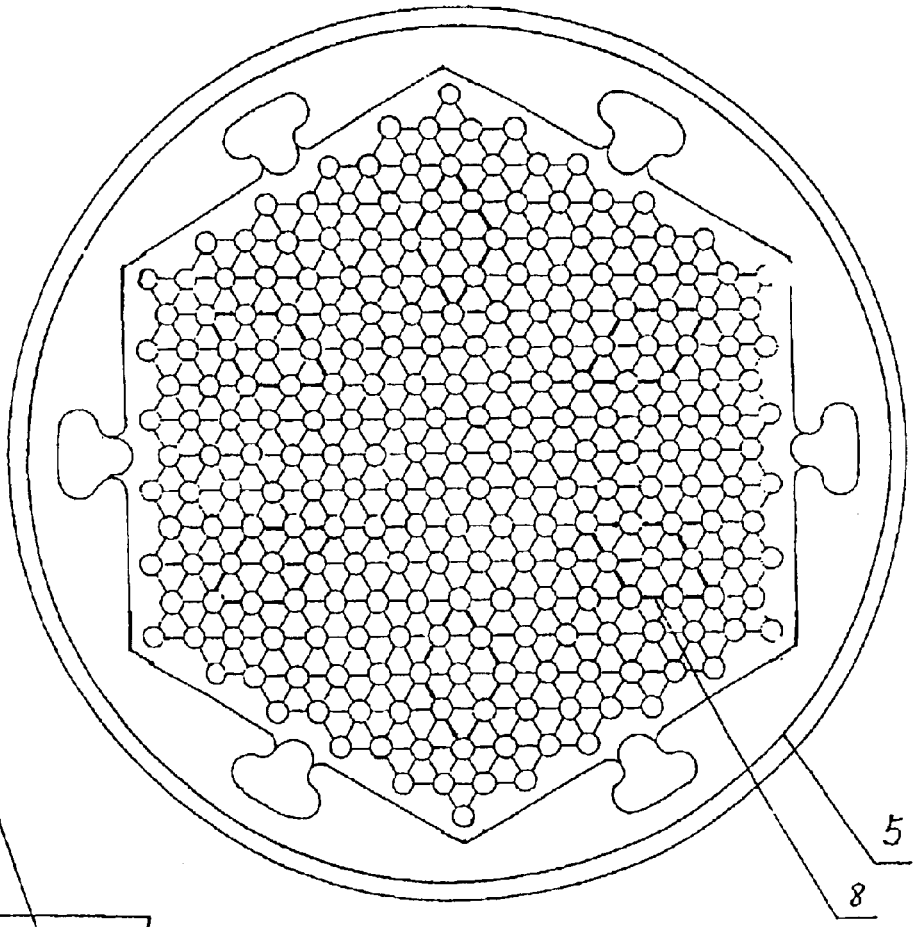
FIG. 6 is a schematic view of the inner wall of the enclosure of a table according to an embodiment of the present invention

Referring to FIG. 6, the outer wall of the enclosure according to this embodiment is a circle, all is the same as embodiment 1 for the others.

Embodiment 4

According to this embodiment, a rotating disk 18 includes a upper disk and a lower disk, and they are made of plaster or other materials, a circular and embossed track or a ball bearing device 19 is positioned between the two disks. The two disks are connected by gripping jaws or a bolt. The rotating disk 18 is positioned between the board 12 and the table support. The ball table and the upper disk 20 can be cast as an integral. Elastic material 21 which has friction is pasted on the disk 18 which can be removed from the table. A flat panel is mounted on the table support, and 4 to 8 gripping jaws are fixed on the flat panel to fasten the lower disk 22 to the panel. The lower disk 22 and the panel of the table support can be an integral. The diameter of the disk 18 is larger than the radius of the table. All is the same as embodiment example 1 for the others.

Utility in Industry

According to the present invention, same standard tables with multiple functions can be easily made, sizes of which depend on playing space, and the operating effect is the same. The table can not only make the moving balls stopped stably at the ball positions of the table eventually, but also can prevent balls from moving out of the table or jumping out of the bank, so games can be played continuously and safely. The table has many advantages, for example, it can save playing space and material for making it. The players can determine playing techniques easily according to the specific design of the table when players play games, thus players will have more entertainment and competition.

What is claimed is:

1. A game table comprising:

a panel mounted on a board, said panel comprising a plurality of sunken ball positions, wherein said ball positions are arranged evenly to define a plurality of concentric hexagons in said panel;

a bank positioned along a periphery of said panel and connected to said board, wherein said bank has a greater height than said panel; and a plurality of holes having portions defined by said bank and by said board.

2. The table of claim 1, wherein said plurality of hexagons are equally spaced within said panel, and said plurality of ball positions are equally spaced within said hexagons, wherein an equilateral triangle is formed by said ball position at an intersection point of every two of a plurality of inner walls of said bank and two of said ball positions located adjacent to each other, said ball positions being symmetrically arranged on both sides of a midpoint of a line which links two of said plurality of holes which oppose each other, wherein the distance between a center of two of said ball positions and a center of a curved entry surface of any two of said holes is the same.

3. The table of claim 2, wherein said panel is a horizontal plane layer made of an elastic material, and said ball positions are arranged in said horizontal plane layer.

4. The table of claim 1, wherein said panel further comprises:

a buffer layer of elastic material, wherein said ball positions are located in said elastic material and said board; and a step-like plane comprised of at least two levels, said ball positions being arranged in said step-like plane, wherein said ball positions located near an inner wall of said bank are at a greater height than said ball positions located near a center of said panel, said ball positions being through holes having straight walls in said panel.

5. The table of claim 1, further comprising:

an enclosure having at least one layer, located along an outer wall of said bank, wherein said enclosure is at a greater height than said bank, and a top of said enclosure is one of either a horizontal plane or an inclined plane inclining from a bottom to said top.

6. The table of claim 5, wherein said enclosure further comprises:

an upper layer enclosure and a lower layer enclosure, said upper layer enclosure being wider than said lower layer enclosure, wherein an inner wall of said upper layer enclosure is the inclined plane tapering from a top to a bottom, and a plurality of target area signs are one of either fixed or engraved on said lower layer enclosure.

7. The table of claim 5, wherein an outer wall of said enclosure is one of either a circle or a polygon with more than six sides, said inner wall of said enclosure is one of either a circle or an equilateral dodecagon, and said inner wall of said bank is a hexagon.

8. The table of claim 1, wherein a ball table support is provided under said board, and a rotating disk is provided between said board and said table support.

9. The table of claim 1, wherein three of a plurality of ball position parallel lines are located between every two of said ball positions of an outermost layer near said bank, and a distance between every two of said ball positions located adjacent each other is twice as long as a distance between said adjacent parallel lines connecting said ball positions.

10. The table of claim 1, wherein said bank and said board are integral, said holes, are comprised of a small inlet and a large body that are formed by a curved belly surface and a curved entry surface, said curved belly surface and said curved entry surface being formed respectively by a plurality of circular surfaces with different radii, wherein said curved belly surface joins said curved entry surface smoothly.

* * * * *